US005236141A

United States Patent [19]

Kewin

[11] Patent Number: 5,236,141

[45] Date of Patent: Aug. 17, 1993

[54] TUBULAR CORE ASSEMBLIES FOR ROLLS OF PAPER OR OTHER SHEET MATERIAL

[76] Inventor: Daniel D. Kewin, 16 Dogwood Drive, Brantford, Ontario, Canada, N3R 1R3

[21] Appl. No.: 857,006

[22] Filed: Mar. 25, 1992

[51] Int. Cl.[5] ..... B65H 75/10; B65H 75/30

[52] U.S. Cl. ..... 242/68.6

[58] Field of Search ..... 242/68.6, 68.5, 68, 242/68.4, 118.31

[56] References Cited

U.S. PATENT DOCUMENTS

| | | | |
|---|---|---|---|
| 659,306 | 10/1900 | Kingsland | 242/68.6 |
| 1,180,955 | 4/1916 | Stuck | 242/68.6 |
| 1,687,586 | 10/1928 | Parker | 242/68.6 |
| 2,076,870 | 4/1937 | Taylor . | |
| 2,266,494 | 12/1941 | Adams | 242/68.6 |
| 2,760,732 | 8/1956 | Bebie | 242/68.6 |
| 3,291,413 | 12/1966 | Cushing et al. | 242/68.6 |
| 4,659,031 | 4/1987 | Saraisky | 242/68.6 X |
| 4,874,139 | 10/1989 | Kewin | 242/68.6 |

FOREIGN PATENT DOCUMENTS

| | | | |
|---|---|---|---|
| 579023 | 7/1959 | Canada | 242/68.6 |
| 602921 | 8/1960 | Canada | 242/68.6 |
| 711624 | 6/1965 | Canada | 242/68.6 |
| 888860 | 2/1962 | United Kingdom | 242/68.6 |

*Primary Examiner*—John M. Jillions
*Attorney, Agent, or Firm*—Rogers & Scott

[57] ABSTRACT

A tubular core assembly for a roll of paper or other sheet material has a hollow cylindrical core member formed by multiple wraps of paperboard material, and an annular collar is located within each opposite end portion of the core member, each collar being a rigid body of non-isotropic material having an outer annular surface secured to the inner annular surface of the core member. An annular end member of metal or plastic material has a sleeve portion within the collar at each end of the tubular core assembly, the sleeve portion having an outer annular surface secured to the inner annular surface of the collar and an inner annular surface shaped to receive a roll supporting chuck.

14 Claims, 4 Drawing Sheets

TUBULAR CORE ASSEMBLIES FOR ROLLS OF PAPER OR OTHER SHEET MATERIAL

Figure 1:
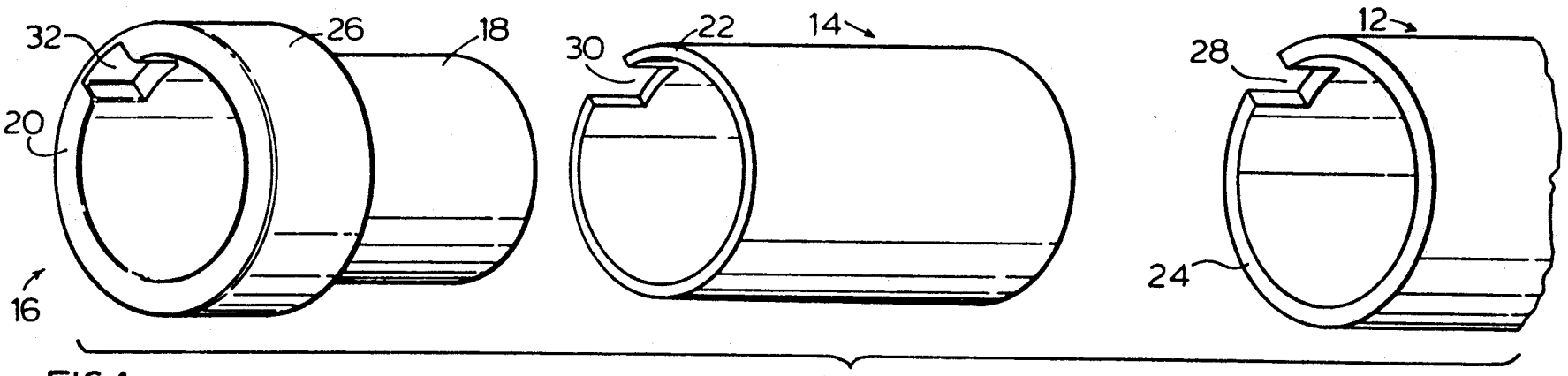

This invention relates to tubular core assemblies for rolls of paper or other sheet material.

U.S. Pat. No. 4,874,139 issued Oct. 17, 1989 describes a tubular core assembly which includes a hollow cylindrical core member formed by multiple wraps of paperboard material and an annular collar of compressed wood material in each opposite end portion of the hollow cylindrical core member. Improvements in such tubular core assemblies are the subject of my U.S. patent application Ser. No. 07/825,887 filed Jan. 27, 1992. The contents of said U.S. Patent and patent application are hereby incorporated herein by reference. After use, the collars of the tubular core assemblies can be pried out of the core member so that the core member can be recycled, for example by crushing and repulping. The collars can also be separately crushed and repulped. These tubular core assemblies are intended to be single use products whose component parts can readily be recycled. Such products are suitable for use in many instances.

However, in some instances, for example when a tubular core assembly is likely to be subjected to relatively high stresses in use, it would be advantageous for at least some part of each end portion of the tubular core assembly to be of a material stronger than multiple wraps of paperboard material or compressed wood material.

It would further be advantageous for each said end portion to be strong engough to resist extreme transit crush impacts without the use of supporting plugs, since such plugs can disrupt roll preparation systems in automated large volume press rooms.

It has been known for many years to provide tubular core assemblies in which the core members have metal end caps of one kind or another. However, the component parts of such prior tubular core assemblies are not easily reused or recycled because it is difficult to separate the metal end caps from the core members without damage for reuse and also because the core members are relatively thick and not easily crushed for repulping.

It is therefore an object of the invention to provide a tubular core assembly wherein at least one part of each end portion is of a relatively strong material and whose component parts are readily reused or recyled.

According to one aspect of the invention, a tubular core assembly for a roll of paper or other sheet material comprises a hollow cylindrical core member formed by multiple wraps of paperboard material, an annular collar within each opposite end portion of the core member, each collar being a rigid body of non-isotropic material and having an outer annular surface secured to the inner annular surface of the core member, and an annular end member of metal or plastic material having a sleeve portion within the collar at each end of the tubular core assembly, said sleeve portion having an outer annular surface secured to the inner annular surface of the collar and an inner annular surface shaped to receive a roll supporting chuck. The term paperboard material is intended to include paper.

After use, the metal or plastic annular end members, the collars and the core member can be readily separated without damaging the end members. The end members can thus be re-used, and the collars and the core member can be recycled.

Each annular end member may have an end portion extending radially outwardly from the sleeve portion across the end of the collar and the end of the core member. Each annular end member may also have an outer portion extending rearwardly from the end portion thereof and surrounding the outer surface of the core member.

The core member and each collar may each have a recess extending inwardly from the ends thereof at the respective end of the tubular core assembly and in which a notch in the respective end member is seated to receive a projection on a roll supporting chuck.

The sleeve portion of each annular end member may have an internal diameter in the range of from about 3 to about 5 inches and a wall thickness of about 0.03 inches, each collar may have an external diameter in the range of from about 3.5 to about 5.5 inches, and the core member may have an outer diameter in the range of from about 4 to about 6 inches.

The sleeve portion of each annular end member may have a length in the range of from about 1.5 to about 4 inches, each collar may have a length in the range of from about 2 to about 6 inches, and the core member may have a length in the range of from about 2 to about 10 feet.

The sleeve portion of each end member may have at least one radially-projecting lug at the respective end of the tubular core assembly, and the core member and each collar may have at least one lug-receiving notch at each respective end receiving the or each lug to facilitate transmission of torque and axial chuck pressure from the end member to the core member. The sleeve portion of each end member may have a pair of said lugs at diametrically opposite positions, and the core member and each collar may likewise each have a pair of lug-receiving notches at diametrically opposite positions receiving said lugs.

Each collar and end member sleeve portion may each have a recess extending inwardly from the ends thereof at the respective end of the tubular core assembly providing a notch to receive a projection on a roll supporting chuck, the projection-receiving notches being located circumferentially mid-way between said pair of lug notches.

Where said lugs are provided, the sleeve portion of each annular end end member may have an internal diameter in the range of from about 3 to about 5 inches and a wall thickness of about 0.15 inches, each collar may have an external diameter in the range of from about 3.5 to about 5.5 inches, and the core member may have an outer diameter in the range of from about 4 to about 6 inches. The sleeve portion of each annular end member may have a length in the range of from about 1.5 to about 5 inches, each collar may have a length in the range of from about 2 to about 6 inches, and the core member may have a length in the range of from about 2 to about 10 feet.

According to another aspect of the invention, a tubular core assembly for a roll of paper or other sheet like material comprises a hollow cylindrical core member formed by multiple wraps of paperboard material, an annular end member of metal or plastic material within each opposite end portion of the core member, each end member having an outer annular surface secured to the inner annular surface of the core member and an inner annular surface shaped to receive a roll supporting chuck, each end member having at least one radially-projecting lug at the respective end of a tubular core assembly, and said core member having at least one lug-receiving notch at each end receiving the or each lug of the respective end member to facilitate transmission of torque and axial chuck pressure from the end member to the core member.

After use, the end members can be readily separated without damage from the core member. The end members can thus be reused and the core member can be recycled, for example by crushing and repulping.

Each end member may have a pair of said lugs at diametrically opposite positions, and the core member may have a pair of lug-receiving notches at diametrically opposite positions at each end receiving said lugs.

Each end member may have a notch extending inwardly from the respective end of the tubular core assembly for receiving a projection on a roll supporting chuck, said projection receiving notch being located circumferentially mid-way between said pair of lug notches.

The ratio of end member wall thickness to core member wall thickness may be in the range of from about 1.3:1 to about 1.5:1.

Each end member may have an internal diameter in the range of from about 3 to about 5 inches and an outer diameter in the range of from about 3.5 to about 5.5 inches, and the core member may have an outer diameter in the range of from about 4 to about 6 inches. Each end member may have a length in the range of from about 1.5 to about 5 inches, and the core member may have a length in the range of from about 2 to about 10 feet.

Each lug may have a substantially rectangular section, and each lug-receving notch may have a complementary rectangular section in which the respective lug is a close fit.

According to yet another aspect of the invention, a tubular core assembly comprises a hollow cylindrical core formed by multiple wraps of paperboard material, an annular end member of metal or plastic material within each opposite end portion of the core member, each annular end member having an outer annular surface secured to the inner annular surface of the core member, an annular collar within the annular end member at each end of the tubular core assembly, each collar being of non-isotropic material and having an outer surface secured to the inner annular surface of the end member and an inner annular surface shaped to receive a roll supporting chuck. Each end member has at least one radially outwardly projecting lug at the respective end of the tubular core assembly, the core member having at least one lug-receiving notch at each respective end receiving the or each outwardly-projecting lug, and each end member also has at least one radially inwardly projecting lug at the respective end of the tubular core assembly, the collar having at least one lug-receiving notch at the respective end receiving the or each inwardly-projecting lug. The outwardly and inwardly projecting lugs facilitate the transmission of torque and axial chuck pressure from the collars to the core member.

The outwardly and inwardly projecting lugs may be adjacent one another and lie on the same radius.

Each end member may have a pair of outwardly-projecting lugs at diametrically opposite positions and a pair of inwardly-projecting lugs at diametrically opposite positions, each outwardly projecting lug being adjacent and lying on the same radius as a respective one of the inwardly-projecting lugs.

Each end member and collar may each have a recess extending inwardly from the ends thereof at the respective end of the tubular core assembly providing a notch to receive a projection on a roll supporting chuck, the projection-receiving notch being located circumferentially mid-way between the respective pairs of outwardly and inwardly projecting lugs.

Each collar may have an internal diameter in the range of from about 3 to about 5 inches, each end member having an internal diameter in the range of from about 3.3 to about 5.3 inches and a wall thickness of about 0.15 inches, and the core member having an outer diameter in the range of from about 4 to about 6 inches.

Each collar may have a length in the range of from about 1.5 to about 5 inches, each end member may have a length in the range of from about 1.5 to about 5 inches, and the core member may have a length in the range of about 2 to about 10 feet.

Figure 2:
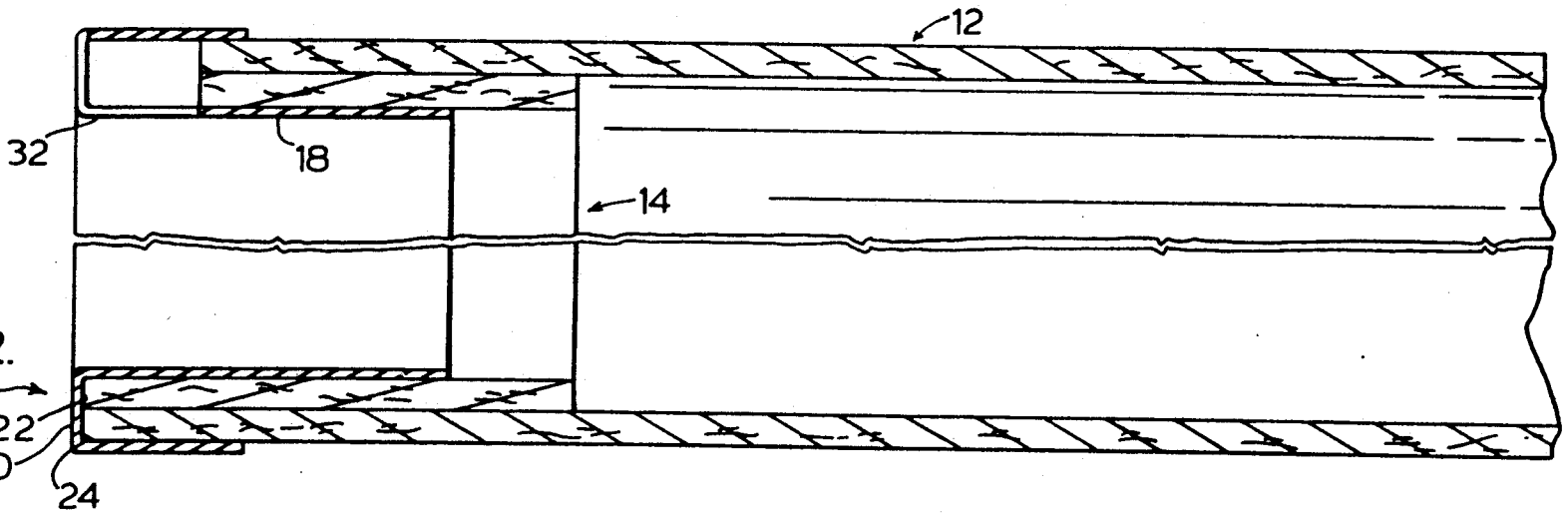
Figure 3:
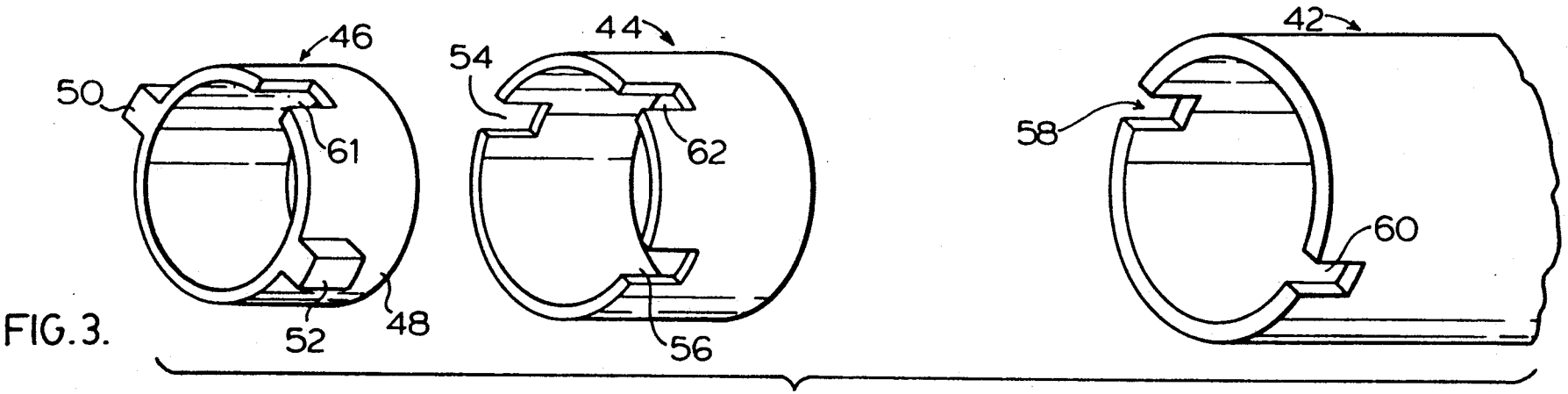
Figure 5:
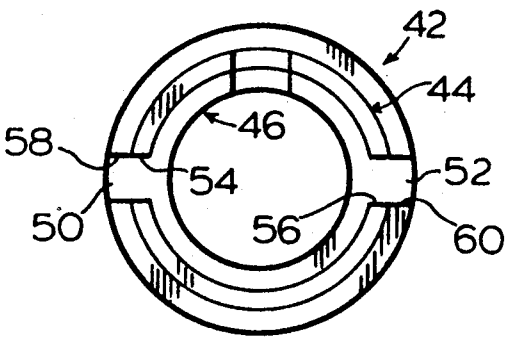
Figure 4:
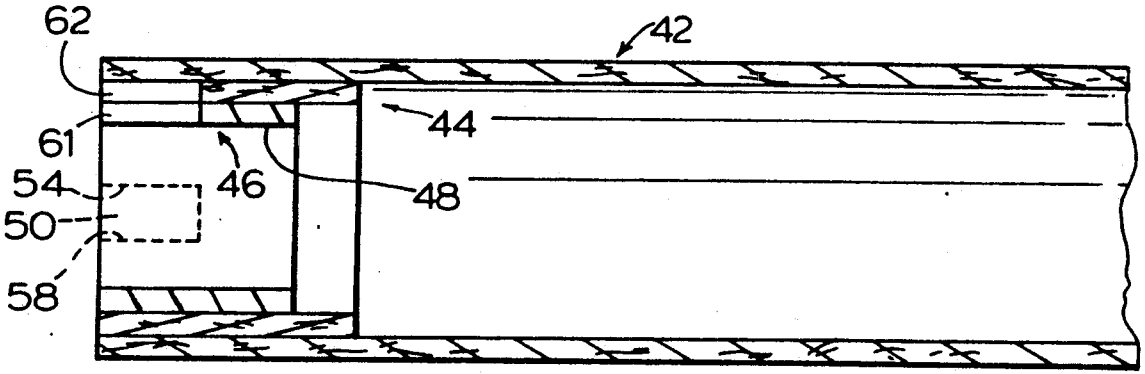
Figure 6:
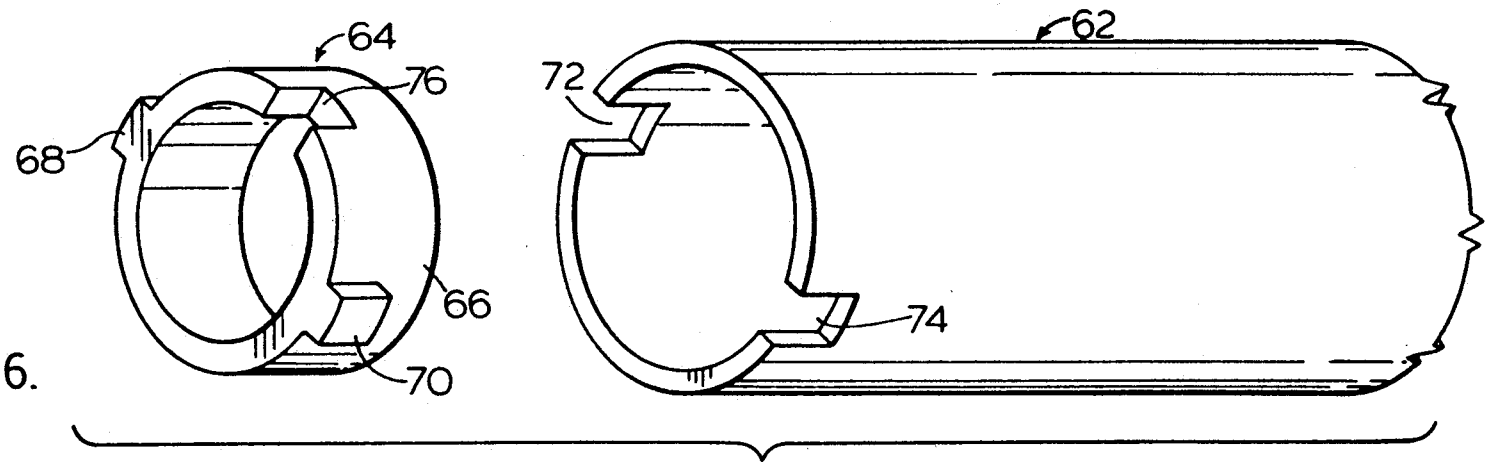
Figure 8:
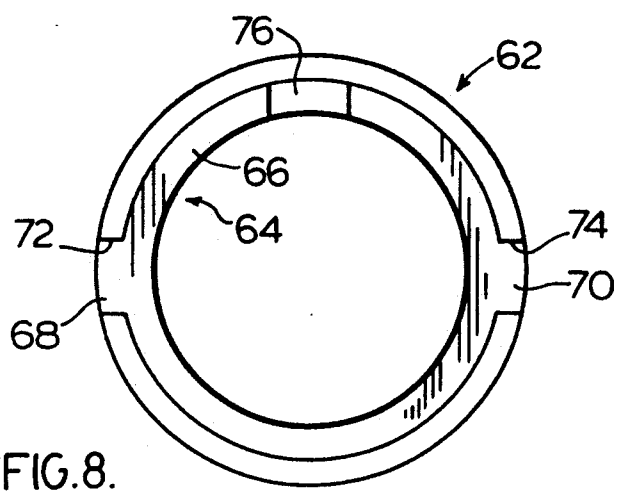
Figure 7:
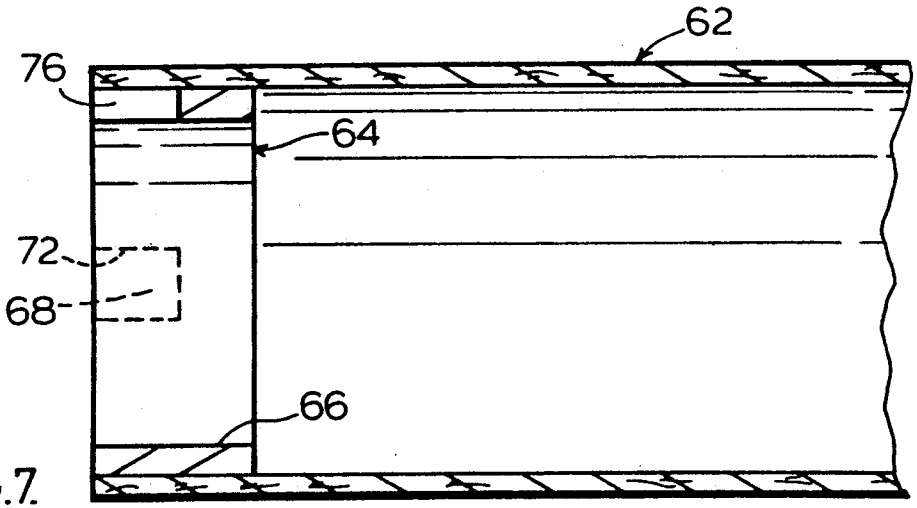

Embodiments of the invention will now be described, by way of example, with reference to the accompanying drawings, of which:

FIG. 1 is an exploded perspective view of a tubular core assembly in accordance with one embodiment of the invention, FIG. 2 is a sectional side view of the tubular core assembly of FIG. 1 in assembled condition, FIG. 3 is an exploded perspective view of a tubular core assembly in accordance with a second embodiment of the invention, FIG. 4 is a sectional side view of the tubular core assembly of FIG. 3 in assembled condition, FIG. 5 is an end view of the tubular core assembly of FIG. 4, FIG. 6 is an exploded perspective view of a tubular core assembly in accordance with a third embodiment of the invention, FIG. 7 is a sectional side view of the tubular core assembly of FIG. 6 in assembled condition, FIG. 8 is an end view of the tubular core assembly of FIG. 7.

Figure 9:
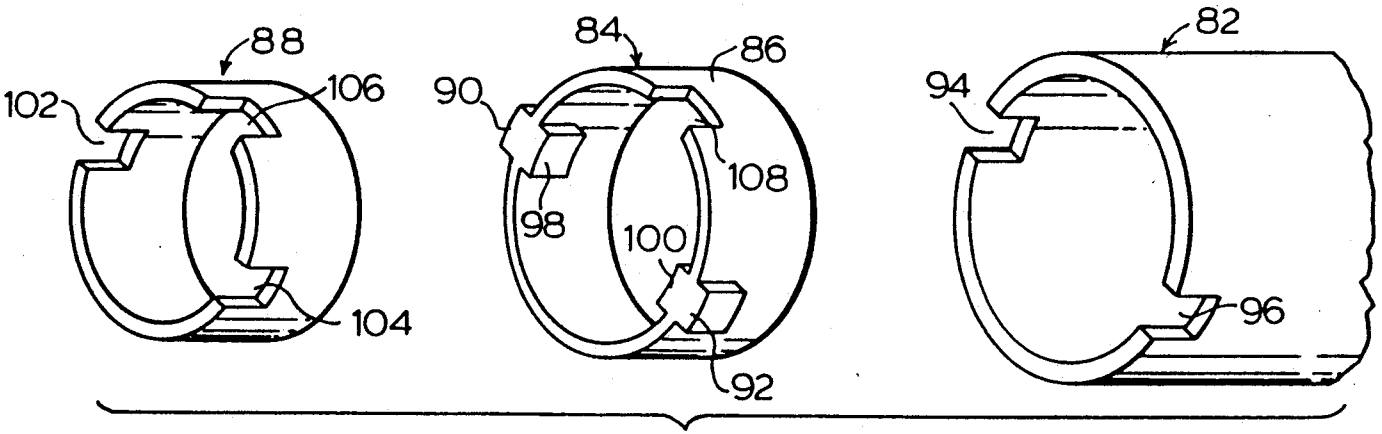
Figure 11:
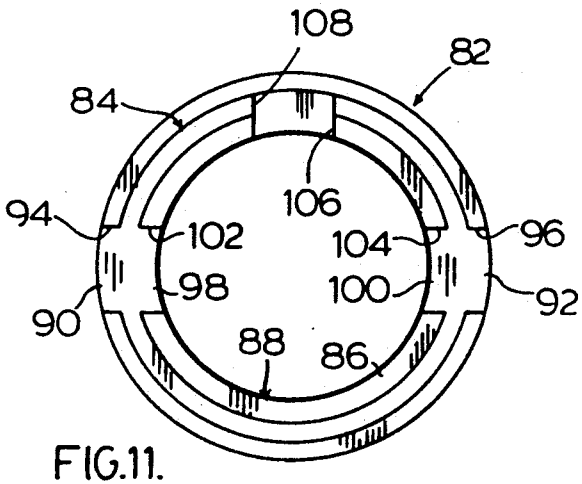
Figure 10:
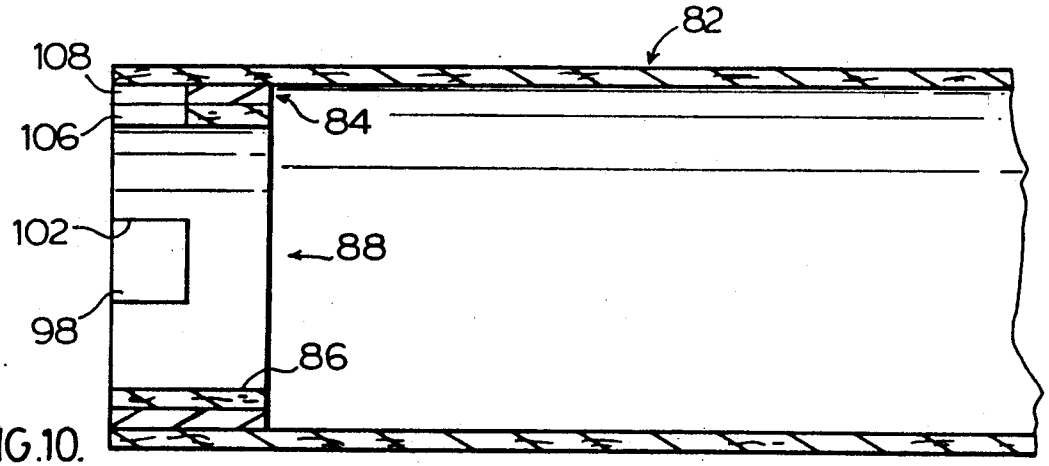

FIG. 9 is an exploded perspective view of a tubular core assembly in accordance with a fourth embodiment of the invention, FIG. 10 is a sectional side view of the tubular core assembly of FIG. 9, and FIG. 11 is an end view of the tubular core assembly of FIG. 9.

Referring to the drawings, FIGS. 1 and 2 show a tubular core assembly for a paper roll which comprises a hollow cylindrical core member 12, an annular collar 14 secured within each opposite end portion of the core member 12, and a metal annular end member 16 having a sleeve portion 18 secured within each collar 14. The core member is formed from strips (i.e. plies) of spirally wound Kraft paperboard, which is about 90% wood fibre with a thickness of 0.012 inches, these strips having a width of about 10 inches and being wound at a winding angle of about 20°. The core member 12 may be constructed in accordance with the teaching in U.S. Pat. No. 3,194,275 (Biggs Jr. et al) issued Jul. 13, 1965, the contents of which are hereby incorporated herein by reference. The teaching of Biggs Jr. et al is a spirally wound paper tube intended to be used as a core or carrier for heavy sheet material such as carpet material or the like, such tubes normally having a length of the order of about 12 feet. In contrast, the core member 12 of the present invention will normally have a length of from about 5 to 10 feet. A conventional core member for paper rolls is usually formed from plies with a thickness of about 0.035 inches and a width of about 4 to 5 inches and a spiral winding angle of about 65°.

The Kraft paperboard referred to above as used in the preferred embodiments of the present invention has relatively long fibres which, when incorporated in a core member 12 formed in the manner described above, become substantially parallel to the length of the core member 12 and assist in maintaining dimensional stability.

Each collar 14 is formed of non-isotropic material such for example a compressed wood material such as moldwood, and has an outer annular surface which is a sliding fit in an end portion of the core member 12. Each collar 14 is secured in place by a suitable glue so that torque can be properly transmitted from the collars 14 to the core member 12.

The sleeve portion 18 of each metal end member 16 has an outer annular surface which is a sliding fit in the respective collar 14. Each sleeve portion 18 is secured in place by a suitable glue so that torque can properly be transmitted from the sleeve portions 18 to the collars 14. An end portion 20 extends radially from the sleeve portion 18 across the end 22 of the respective collar 14 and the respective end 24 of the core member 12. An outer portion 26 extends rearwardly from the end member 20 and surrounds the outer surface of the core member 12.

The core member 12 and each collar 14 have rectangular recesses 28, 30 respectively extending inwardly from the ends thereof and in which a rectangular notch 32 in the respective end member 16 is seated to receive a projection on a roll supporting chuck. The inner annular surface of the sleeve portion 18 is shaped to receive the chuck.

The tubular core assembly described with reference to FIGS. 1 and 2 is useful as a core for a paper roll. In practice, such rolls may weigh about 1 ton and have a diameter of about 40 inches. When paper is wound onto or unwound from the core, a speed of about 160–1600 revolutions per minute may be attained, as the roll decreases from large to small diameter, since the paper travels at a constant linear speed.

After use, the metal end members 16 can be pried without damage from the collars 14, and the collars 14 can be pried from the core member 12. The metal end member 16 can be reused, and the collars 14 and the core member 12 can be separately recycled by crushing and repulping.

The sleeve portion 18 of the metal end member 16 may have an internal diameter in the range of from about 3 to about 5 inches and a wall thickness of about 0.03 inches, the collars 14 may have an external diameter in the range of from about 3.5 to about 5.5 inches, and the core member 12 may have an outer diameter in the range of from about 4 to about 6 inches.

The sleeve portion 18 of the metal end member 16 may have a length in the range of from about 1.5 to about 4 inches, the collars 14 may have a length in the range of from about 2 to about 6 inches, and the core member 12 may have a length in the range of from about 2 to about 10 feet.

In one specific example of this embodiment of the invention, the sleeve portion 18 of the metal end member 16 has an internal diameter of 3 inches, a wall thickness of 0.031 inches and a length of 3 inches. The collars 14 have an external diameter of 3.6 inches and a length of 3.5 inches. The core member 12 has an outer diameter of 4 inches and a length of 4.5 feet.

The metal end member 16 may be made be made of a suitable iron, for example carbon C10 or C20. Alternatively, the end members 16 may be made of a suitable plastic material, for example injection moulding grade 25% glass filled nylon type 6.

It will be noted that not only can the parts of the above described tubular core assembly be easily re-used or recycled but also that the tubular core assembly combines the advantages of a relatively thin walled core member with the strength of a metal or plastic end member.

Referring now to FIGS. 3 to 5, a tubular core assembly in accordance with a second embodiment of the invention comprises a hollow cylindrical core member 42, an annular collar 44 secured within each opposite end portion of the core member 42, and a metal annular end member 46 having a sleeve portion 48 secured within each collar 44. Core member 42 is constructed in a similar manner to the core member 12 of the previous embodiment and the collars 44 are constructed in a similar manner to the collars 14 of the previous embodiment. Each collar 44 has an outer annular surface which is a sliding fit in an end portion of the core member 12 and is secured in place by a suitable glue.

The sleeve portion 48 of each metal end member 46 has an outer annular surface which is a sliding fit in the respective collar 14 and is secured in place by a suitable glue. Each end member 46 has a pair of lugs 50, 52 of rectangular section projecting radially outwardly at diametrically opposite positions from the end of the sleeve portion 48 at the end of the core member 42. The lugs 50, 52 are located in recesses 54, 56 and 58, 60 of rectangular section at corresponding positions in the collar 44 and the core member 42 respectively. The lugs 50, 52 facilitate the transmission of torque and axial chuck pressure from the end members 46 to the core member 42 and, because of their diametrically-opposite locations, provide dynamic balance during rotation of the tubular core assembly.

The sleeve portion 48 of each metal end member 46 and each collar 44 have notches 61, 62 respectively of rectangular section extending inwardly from the ends thereof at a position circumferentially midway between the lugs 50, 52 to receive a projection on a roll supporting chuck. The inner annular surface of the sleeve portion 48 of each metal end member 46 is shaped to receive the chuck.

The tubular core assembly described with reference to FIGS. 3 to 5 can be used in the same manner as the tubular core assembly described with reference to FIGS. 1 and 2.

The sleeve portions 48 of the metal end members 46 may have an internal diameter in the range of from about 3 to about 5 inches and a wall thickness of about 0.15 inches, the collars 44 may have an external diameter in the range of from about 3.5 to about 5.5 inches, and the core member 42 may have an outer diameter in the range of from about 4 to about 6 inches.

The sleeve portions 48 of the metal end members 46 may have a length in the range of from about 1.5 to about 5 inches, the collars 44 may have a length in the range of from about 2 to about 6 inches, and the core member 42 may have a length in the range of from about 2 to about 10 feet.

In a specific example of this embodiment of the invention, the sleeve portions 48 of the metal end members 46 have an internal diameter of 3 inches, a wall thickness of 0.15 inches and a length of 1.5 inches. The collars 44 have an external diameter of 3.6 inches and a length of 2 inches. The core member 42 has an outer diameter of 4 inches and a length of 4.5 feet.

It will be noted that not only can the parts of the above described tubular core assembly be readily reused or recycled but also that the tubular core assembly combines the advantages of a relatively thin walled core member with the strength of a metal end member.

As in the previous embodiment, the metal end members 46 may be made of a suitable iron. Alternatively, the end members 46 may be made of a suitable plastic material.

Referring now to FIGS. 6 to 8, a tubular core assembly in accordance with a third embodiment of the invention comprises a hollow cylindrical core member 62 and a thick annular end member 64 with a sleeve portion 66 within each opposite end portion of the core member 62. The core member 62 is constructed in a similar manner to the core members 12 and 42 of the previous embodiments.

The sleeve portion 66 of each end member 64 has an outer annular surface which is a sliding fit in an end portion of the core member 62 and is secured in place by a suitable glue. Each end member 64 has a pair of lugs 68, 70 of rectangular section projecting radially outwardly at diametrically opposite positions from the end of the sleeve portion 66 at the end of the core member 62. The lugs 68, 70 are located in recesses 72, 74 of rectangular section at corresponding positions in the core member 62. The lugs 60, 70 facilitate the transmission of torque and axial pressure from the metal end members 66 to the core member 62 and, because of their diametrically-opposite positions, provide dynamic balance during rotation of the tubular core assembly.

The sleeve portion 66 of each end member 64 has a notch 76 of rectangular section extending inwardly from the end thereof at a position circumferentially midway between the lug 68, 70 to receive a projection on a roll supporting chuck. The inner surface of the sleeve portion 66 is shaped to receive the chuck.

The tubular core assembly described with reference to FIGS. 6–8 can be used in the same manner as the previously described embodiments.

The ratio of end member wall thickness to core member wall thickness is in the range of from about 1.3:1 to about 1.5:1. The sleeve portion 66 of each end member 64 has an internal diameter in the range of from about 3 to about 5 inches and an outer diameter in the range of from about 3.5 to about 5.5 inches. The core member 62 has an outer diameter in the range of from about 4 to about 6 inches. Each end member has a length in the range of from about 1.5 to about 5 inches, and the core member has a length in the range of from about 2 to about 10 feet.

In a specific example of the invention, the ratio of end member wall thickness to core member thickness is 1.5:1. The sleeve portion 66 of each end member 64 has an internal diameter of 3 inches, an external diameter of 3.6 inches and a length of 1.5 inches. The core member 62 has an outer diameter of 4 inches and a length of 4.5 feet.

It will be noted that not only can the parts of the above described tubular core assembly be readily reused or recycled but also that the tubular core assembly combines the advantages of a relatively thin walled core member with the strength of a metal end member, which is sufficient to withstand extreme transit impact without the support of an end plug. It will be noted that the end member 64 is as thick as the end member 46 and collar 44 combined of the previous embodiment.

As in the previous embodiments, the metal end members 64 may be made of a suitable iron. Alternatively, the end members 64 may be made of a suitable plastic material.

Referring now to FIGS. 9–11, a tubular core assembly in accordance with a fourth embodiment of the invention comprises a hollow cylindrical core member 82, a metal end member 84 having a sleeve portion 86 secured within each opposite end portion of the core member 82, and a collar 88 secured within each sleeve portion 86. Core member 84 is constructed in the same manner as the core members of the previous embodiments, and the collars 88 are constructed in the same manner as the collars of the previous embodiments. The sleeve portion 86 of each end member 84 has an outer annular surface which is a sliding fit in an end portion of the core member 82 and is secured in place by a suitable glue. Each collar 88 has an outer annular surface which is a sliding fit in the respective sleeve portion 86 and is secured in place by a suitable glue.

The sleeve portion 86 of each end member 84 has a pair of lugs 90, 92 of rectangular section projecting radially outwardly at diametrically opposite position from the end of the sleeve portion 86 at the end of the core member 82. The lugs 90, 92 are located in recesses 94, 96 of rectangular section and corresponding positions in the core member 82. The sleeve portion 86 of each end member 84 also has a pair of lugs 98, 100 of rectangular section projecting radially inwardly at diametrically opposite positions. Each outwardly-projection lug 90, 92 is adjacent and lies on the same radius as the inwardly-projecting lug 98 or 100 respectively. The lugs 98, 100 are located in recesses 102, 104 of rectangular section at corresponding positions in the collar 88. The lugs 90, 98 and 92, 100 facilitate the transmission of torque and axial chuck pressure from the collars 88 to the core member 82 and, because of their diametrically-opposite locations, provide dynamic balance during rotation of the tubular core assembly.

Each collar 88 and the sleeve portion 86 of each end member 84 have recesses 106, 108 respectively of rectangular section extending inwardly from the ends thereof at a position circumferentially mid-way between the lugs 90, 100 and 92, 102 to form a notch which receives a projection on a roll supporting chuck. The inner annular surface of the collar 88 is shaped to receive the chuck.

The tubular core assembly described with reference with FIGS. 9–11 can be used in the same manner as the previous embodiments.

The collars 88 may have an internal diameter in the range of from about 3 to about 5 inches, the sleeve portions 86 of end members 84 may have an internal diameter in the range of from about 3.3 to about 5.3 inches and a wall thickness of about 0.15 inches, and the core member may have an outer diameter in the range of from about 4 to about 6 inches.

The collars 88 may have a length in the range of from about 1.5 to about 5 inches, the sleeve portions of the end members 84 may have a length of from about 1.5 to about 5 inches, and the core member 82 may have a length in the range of from about 2 to about 10 feet.

In a specific example of this embodiment of the invention, the collars 88 have an internal diameter of 3 inches and a length of 1.5 inches. The sleeve portions 86 of end members 84 have an internal diameter of 3.3 inches, a wall thickness of 0.15 inches and a length of 1.5 inches. The core member 82 has an outer diameter of 4 inches and a length of 4.5 feet.

It will be noted that not only can the parts of the above described tubular core assembly be readily reused or recycled but also that the tubular core assembly combines the advantages of a relatively thin walled core member with the strength of a metal end member.

As in the previous embodiments, the metal end members 84 can be made of a suitable iron. Alternatively, the end members 84 may be made of a suitable plastic material.

Athough the invention has primarily been described in connection with use for paper rolls, the invention is also useful for rolls of other sheet material, such as plastic film.

Other embodiments of the invention will be readily apparent to a person skilled in the art, the scope of the invention being defined in the appended claims.

I claim:

1. A tubular core assembly for a roll of paper or other sheet material comprising:

a hollow cylindrical core member formed by multiple wraps of paperboard material, an annular collar within each opposite end portion of the core member, each collar being a rigid body of non-isotropic material and having an outer annular surface secured to the inner annular surface of the core member, an annular end member of metal or plastic material having a sleeve portion within the collar at each end of the tubular core assembly, said sleeve portion having an outer annular surface secured to the inner annular surface of the collar and an inner annular surface shaped to receive a roll supporting chuck, the sleeve portion of each end member having a pair of diametrically-opposite radially-projecting lugs at the respective end of the tubular core assembly, the core member and each collar have a pair of diametrically-opposite lug-receiving notches at each respective end receiving said lugs to facilitate transmission of torque and axial chuck pressure from the end member to the core member, and each collar and end member sleeve portion each having a recess extending inwardly from the ends thereof at the respective end of the tubular core assembly providing a notch to receive a projection on a roll supporting chuck, said projection-receiving notch being located circumferentially mid-way between said pair of lug notches.

2. A tubular core assembly according to claim 1 wherein the sleeve portion of each annular end member has an internal diameter in the range of from about 3 to about 5 inches, a wall thickness of about 0.15 inches, and each collar has an external diameter in the range of from about 3.5 to about 5.5 inches, and the core member has an outer diameter in the range of from about 4 to about 6 inches.

3. A tubular core assembly according to claim 2 wherein the sleeve portion of each annular member has a length in the range of from about 1.5 to about 5 inches, each collar has a length in the range of from about 2 to about 6 inches, and the core member has a length in the range of from about 2 to about 10 feet.

4. A tubular core assembly for a roll of paper or other sheet like material comprising:

a hollow cylindrical core member formed by multiple wraps of paperboard material, an annular end member of metal or plastic material within each opposite end portion of the core member, each end member having an outer annular surface secured to the inner annular surface of the core member and an inner annular surface shaped to receive a roll supporting chuck, each end member having a pair of radially-projecting lugs at diametrically opposite positions at the respective end of the tubular core assembly, and said core member having a pair of lug-receiving notches at diametrically opposite positions at each end receiving said lugs of the respective end member to facilitate transmission of torque and axial chuck pressure from the end member to the core member, and each end member having a notch extending inwardly from the respective end of the tubular core assembly for receiving a projection on a roll supporting chuck, said projection-receiving notch being located circumferentially mid-way between said pair of lug notches.

5. A tubular core assembly according to claim 4 wherein the ratio of end member wall thickness to core member wall thickness is in the range of from about 1.3:1 to about 1.5:1.

6. A tubular core assembly according to claim 4 wherein each end member has an internal diameter in the range of from about 3 to about 5 inches and an outer diameter in the range of from about 3.5 to about 5.5 inches, and the core member has an outer diameter in the range of from about 4 to about 6 inches.

7. A tubular core assembly according to claim 6 wherein each end member has a length in the range of from about 1.5 to about 5 inches, and the core member has a length in the range of from about 2 to about 10 feet.

8. A tubular core assembly according to claim 4 wherein each lug has a substantially rectangular section, and each lug-receiving notch has a complementary rectangular section in which the respective lug is a close fit.

9. A tubular core assembly for a roll of paper or other sheet like material comprising:

a hollow cylindrical core formed by multiple wraps of paperboard material, an annular end member of metal or plastic material within each opposite end portion of the core member, each annular end member having an outer annular surface secured to the inner annular surface of the core member, an annular collar within the annular end member at each end of the tubular core assembly, each collar being of non-isotropic material and having an outer surface secured to the inner annular surface of the end member and an inner annular surface shaped to receive a roll supporting chuck, each end end member having at least one radially outwardly projecting lug at the respective end of the tubular core assembly, the core member having at least one lug-receiving notch at each respective end receiving the or each outwardly- projecting lug, and each end member also having at least one radially inwardly projecting lug at a respective end of the tubular core assembly, the collar having at least one lug-receiving notch at the respective end receiving the or each inwardly-projecting lug, said outwardly and inwardly projecting lugs facilitating the transmission of torque and axial chuck pressure from the collars to the core member.

10. A tubular core assembly according to claim 9 wherein the outwardly and inwardly projecting lugs are adjacent each other and lie on the same radius.

11. A tubular core assembly according to claim 10 wherein each end member has a pair of said outwardly-projecting lugs at diametrically opposite positions and a pair of said inwardly-projecting lugs at diametrically opposite positions, each outwardly-projecting lug being adjacent and lying on the same radius as a respective one of the inwardly-projecting lugs.

12. A tubular core assembly according to claim 11 wherein each end member and collar each have a recess extending inwardly from the ends thereof at the respective end of the tubular core assembly providing a notch to receive a projection on a roll supporting chuck, said projection-receiving notch being located circumferentially mid-way between respective pairs of outwardly and inwardly-projecting lugs.

13. A tubular core assembly according to claim 9 wherein each collar has an internal diameter in the range of from about 3 to about 5 inches, each end member has an internal diameter in the range of from about 3.3 to about 5.3 inches and a wall thickness of about 0.015 inches, and the core member has an outer diameter in the range of from about 4 to about 6 inches.

14. A tubular core assembly according to claim 13 wherein each collar has a length in the range of from about 1.5 to about 5 inches, each end member has a length in the range of from about 1.5 to about 5 inches, and the core member has a length in the range of from about 2 to about 10 feet.

* * * * *